US007665604B2

(12) United States Patent
Taninbaum

(10) Patent No.: US 7,665,604 B2
(45) Date of Patent: Feb. 23, 2010

(54) TAMBOURINE DISPLAY/PROTECTIVE CASE

(75) Inventor: Richard L. Taninbaum, Mamaroneck, NY (US)

(73) Assignee: Rhytm Tech, Inc., New Rochelle, NY (US)

( * ) Notice: Subject to any disclaimer, the term of this patent is extended or adjusted under 35 U.S.C. 154(b) by 391 days.

(21) Appl. No.: 11/689,922

(22) Filed: Mar. 22, 2007

(65) Prior Publication Data

US 2008/0230413 A1 Sep. 25, 2008

(51) Int. Cl.
*A45C 11/00* (2006.01)

(52) U.S. Cl. ..... 206/314

(58) Field of Classification Search ..... 206/314, 206/591, 592, 594; 220/4.21, 4.22, 4.23
See application file for complete search history.

(56) References Cited

U.S. PATENT DOCUMENTS 3,344,913 A * 10/1967 Best ..... 206/314
5,088,377 A * 2/1992 Delecaris ..... 84/422.3
6,670,536 B2 * 12/2003 Godin et al. ..... 84/453
6,866,146 B2 * 3/2005 Heesch ..... 206/314

* cited by examiner

*Primary Examiner*—Jacob K Ackun, Jr.
(74) *Attorney, Agent, or Firm*—Lackenbach Siegel, LLP; Myron Greenspan

(57) ABSTRACT

A protective case for a product, such as a tambourine, having a predetermined configuration includes a clam shell housing generally configured to conform to the shape of the product. The housing is dimensioned to receive the product with clearance. The clam shell housing is formed of two clam shell members that are hinged to each other so that the clam shell members may be separated to allow the product to be inserted into or removed from the case. A suitable lock is provided for selectively locking the clam shell members to each other to prevent a separation of the clam shell members. A handle suitable for gripping is provided on the housing for carrying the case. Positioning members in the form of stabilizing walls are provided within the clam shell housing for positioning the product and stabilizing it against excessive movements within the clam shell housing when the clam shell members are juxtaposed in a closed condition of the clam shell housing. The product is preferably maintained in a generally fixed design position within the clam shell housing where the protection of the product is enhanced. By making the clam shell housing from a transparent molded plastic material the protective case can also serve as a display case through which the product may be viewed.

20 Claims, 3 Drawing Sheets

TAMBOURINE DISPLAY/PROTECTIVE CASE

CROSS-REFERENCE TO RELATED APPLICATION

This application claims priority of U.S. Patent Application No. 60/781,466 filed on Mar. 10, 2006.

BACKGROUND OF THE INVENTION

1. Field of the Invention

The invention generally relates to product packaging and, more specifically, to a tambourine display/protective case.

2. Description of the Prior Art

Numerous packaging cases have been designed for a multitude of different products. Some of these cases are intended to display a product at a point of sale. Some of these cases are intended to produce an aesthetic package to attract consumers. Other cases are designed to at least partially expose a product so that a prospective user can touch and interact or interface with the product contained inside the case in order to sample one or more attributes of the product. An important function of many such cases, or course, are also to protect the product, particularly when not in use. Most cases, for musical instruments for example, include a separate handle for carrying the musical instrument and transporting it from one location to another. However, many of the cases that have been used up to now, and particular cases for musical instruments such as a tambourine, have not provided all of the aforementioned functions, features or benefits.

Accordingly, one object of the invention to provide a display/protective case for a product which does not have the disadvantages or drawbacks of known product cases.

It is another object of the invention to provide a display/protective case as in the previous object, which is simple in construction and economical to manufacture.

It is still another object of the invention to provide a display/protective case of the type in the discussion which is especially suitable for displaying, transporting and safely storing a tambourine such that the tambourine is protected when not in use.

BRIEF DESCRIPTION OF THE DRAWINGS

Various further objects, features and advantages under present invention will be more fully appreciated as the invention will be better understood in light of the accompanying figures, in which.

DETAILED DESCRIPTION OF A PREFERRED EMBODIMENT

Figure 3:
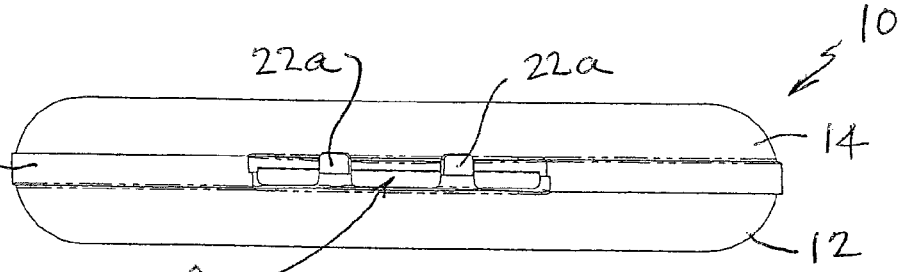
FIG. 3 is a front elevational view of the case shown in FIGS. 1 and 2.

Referring now more specifically to the drawings, in which identical or similar parts are designated by the same reference numerals throughout, and first referring to FIGS. 1-4, and 8, a tambourine display/protective case in accordance with the present invention is generally designated by the reference numeral 10.

Figure 6:
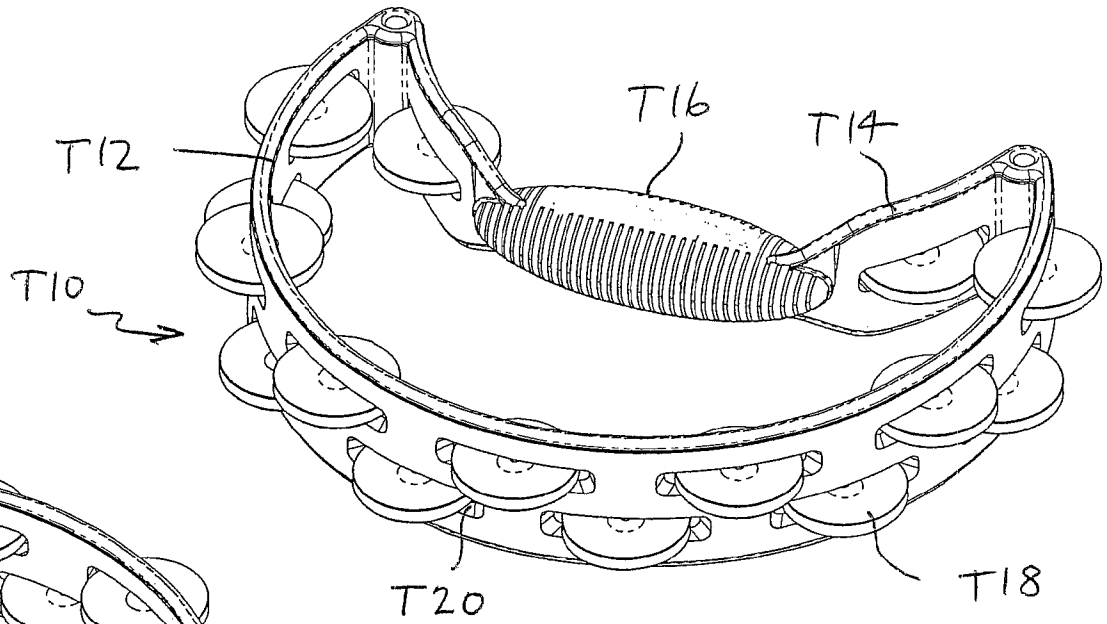
FIGS. 5 and 6 respectively show rear and front perspective views of a tambourine of the type that may be displayed or stored in the case shown in FIGS. 1-4.
Figure 5:
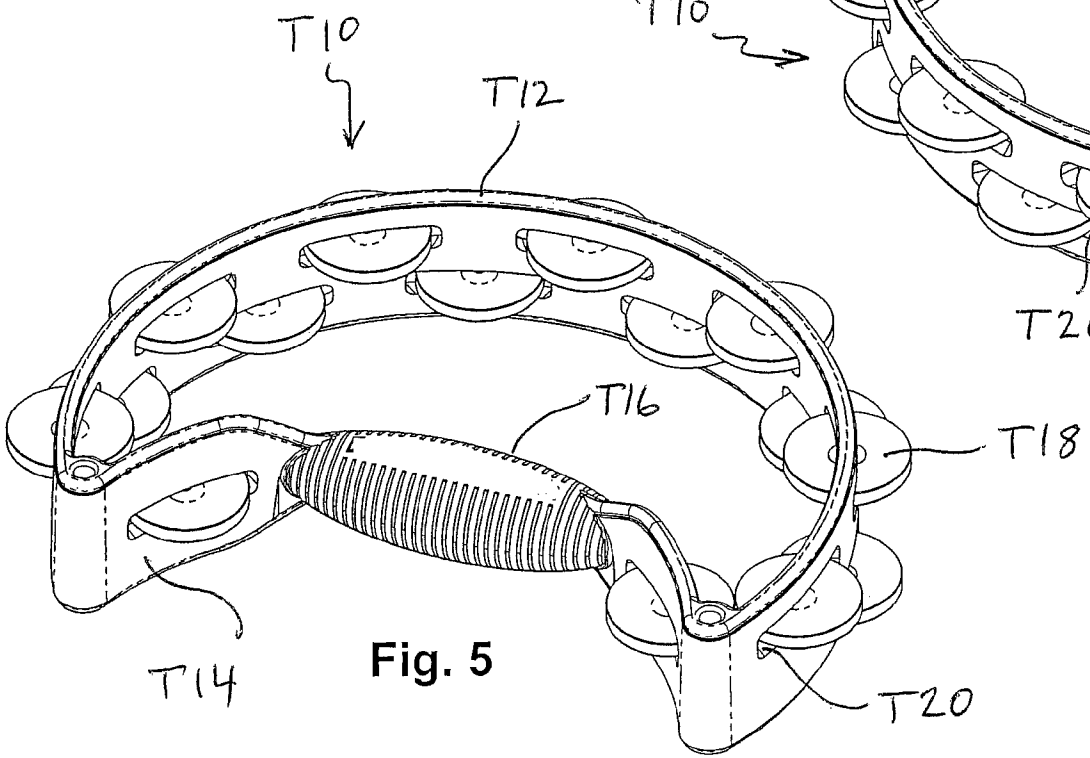

While the case 10 is specifically configured to display, receive and store a specific tambourine, of the type illustrated in FIGS. 5 and 6, it will be clear to those skilled in the art that the display/protective case can be suitably modified to receive and store tambourines having other configurations, such as circular, as well as other small musical instruments and non-musical objects.

The case 10 is in the form of a clam shell housing 11 formed of a lower shell member 12 and upper shell member 14 that are suitably attached to each other at a hinge 16. The hinge 16 may be in the form of a separate piano hinge made, for example, from metal or plastic. However, in the presently preferred embodiment, the hinge 16 is integrally molded with a portion of the rear edges of the lower and upper shell members 12, 14 to form a living hinge.

Figure 2:
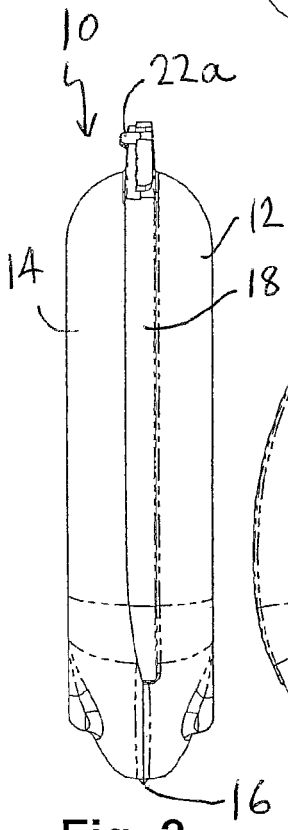
FIG. 2 is a side elevational view of the case shown in FIG. 1.
Figure 1:
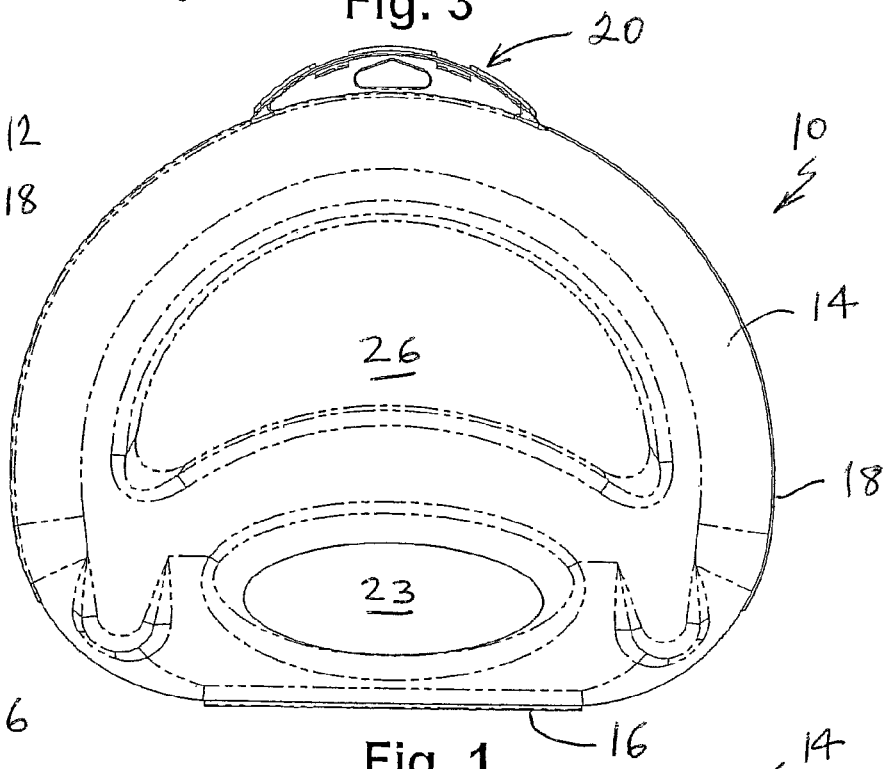
FIG. 1 is a top plan view of tambourine display/protective case in accordance with the present invention, shown in its closed condition.
Figure 4:
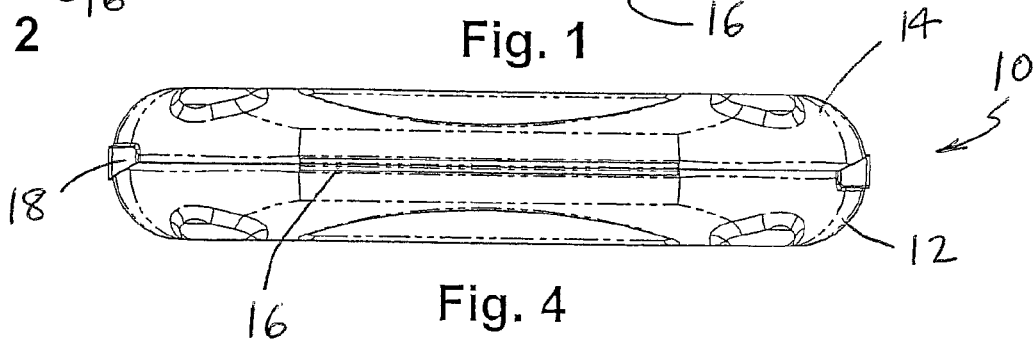
FIG. 4 is a rear elevational view of the case shown in FIGS. 1-3.
Figures 7, 8:
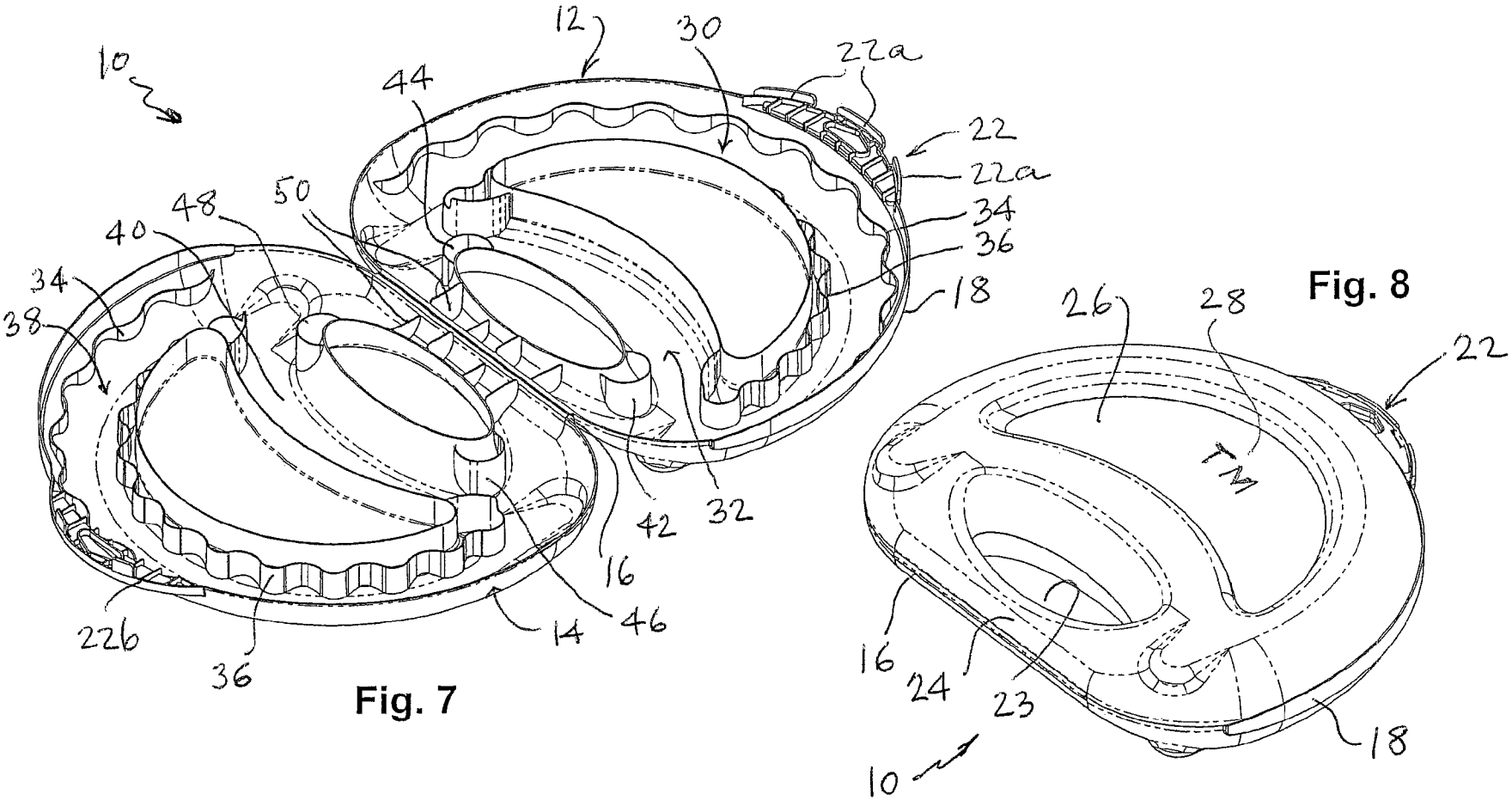
FIG. 7 is a perspective view of the case shown in FIGS. 1-4, shown in its open condition; and, FIG. 8 is a perspective view of the case shown in FIGS. 1-4 and 7, shown in its closed or locked condition.

Referring particularly to FIGS. 2, 3 and 8, there is preferably provided about at least a portion of the lower shell member 12 an upwardly projecting alignment wall 18 which is shown to extend substantially along the sides and the front of the lower shell member 12 and arranged to also receive and surround a corresponding portion of the periphery of the upper shell member 14 when the case is closed, as shown in FIGS. 2-4 and 8. It will be appreciated that the alignment wall 18 prevents excessive shifting of the lower and upper shell members 12, 14 relative to each other, particularly in the living hinge 16 is made of a relatively thin plastic web that does not rigidly maintain the shell members in alignment.

The case 10 is provided with a lock 20, at the front of the case opposite to the position of the living hinge 16 so that when the lower and upper shell members 12, 14 are in abutment with each other, as shown in FIGS. 1-4 and 8, the lock 20 may be selectively closed to prevent inadvertent opening of the case by separation of the shell members from each other. It will be appreciated that any suitable locking mechanism well-known to those skilled in the art may be used. A simple and inexpensive locking mechanism may be used for this purpose. Illustrated in FIG. 3, for example, are a plurality of rigid but somewhat flexible tabs 22*a* projecting upwardly from the lower shell member 12, as viewed in FIG. 7. A suitable detent lip 22*b* is provided in the upper shell member 14 that resiliently snaps against the tabs 22*a* to cause the shell members to lock. Only when the tabs 22*a* are physically outwardly deflected by a user is the detent mechanism rendered ineffective and the tabs may be moved beyond the lip 22*b* to thereby unlock the shell members from each other.

The case 10 illustrated in the Figures is specifically configured to be used in conjunction with a tambourine T10, shown in FIGS. 5 and 6. The details of the tambourine T10 will not be described in full detail in this application, as they are described in co-pending U.S. patent application No. 60/781,466 filed on Mar. 10, 2006 and assigned to the same assignee as the subject application. Thus, the tambourine T10 is generally shown to include a longer arcuate rim, segment or portion T12 and a shorter rim, segment or portion T14 extending to the ends of the arcuate rim T12. A handle T16 is provided on the shorter segment or portion T14. A plurality of jingles T18 are mounted within spaced slots T20 as shown.

When used in conjunction with a tambourine similar to the tambourine T10 shown in FIGS. 5 and 6, the case 10 is advantageously provided with an opening 23 which creates a generally elongate portion 24 that can serve as a handgrip or handle 24 suitable for gripping and carrying the case. As will be evident from FIGS. 5 and 6, the opening 22 is formed to be positioned adjacent or proximate to but beyond the handle T16. Similarly, the case may be provided with recessed portions or panels 26 which are suitably received between the larger arcuate segment T12 and the shorter segment T14, as will become evident in conjunction with FIG. 7. All or part of the region for the recess 26 may also be empty, thus generating another through-opening similar to the opening 23. The resulting webs created by the recessed panels instead of an opening provide suitable surface areas on which a trademark or a logo 28 may be applied.

Referring specifically to FIG. 7, in which the case 10 is shown in its open condition, the lower shell member 12 is shown provided with a larger arcuate channel 30 and a shorter arcuate channel 32. The larger arcuate channel 30 is dimensioned to receive the larger arcuate segment or portion T12 of the tambourine while the shorter or smaller arcuate channel 32 is dimensioned and configured to receive both the shorter segment or portion T14 of the tambourine as well as the handle T16. A first positioning member 34 is provided that extends substantially the entire length of the larger arcuate channel 30 but radially outwardly and generally closer to the outer periphery of the lower shell member 12. A similar second positioning member 36 is provided which is more inwardly than the first position member 34 to define the channel 30. It will be noted that both the first and second positioning members 34, 36 are, in the presently preferred embodiment, undulating or wavy in configuration to provide regions for matingly nesting with and securing the circular outer peripheries of the jingles T18. The first and second positioning members 34, 36 in addition, prevent excessive shifting of the tambourine within the case and stabilize the tambourine during display and transportation or storage of the instrument. Similar larger and smaller channels 38, 40 are provided in the upper shell member 14, the undulations of which generally match the undulations of the positioning members 34, 36 so as to form a continuous pair of undulating walls in both shell members. Additional stabilizing walls 42, 44 are provided in the lower shell member 12 and similar walls 46, 48 are provided in the upper shell member 14, which nest with the tambourine when received within the case. Suitable reinforcing ribs 50 may be provided in those spaces not occupied by the tambourine when received within the case. The ribs 50 in the embodiment shown in FIG. 7, are provided within the handle or handgrip 24 to reinforce the handle against warping or excessive deflection.

It will be appreciated that the tambourine case 10 in accordance with the present invention is simple in construction and may be formed by molding to form the lower and upper shell members 12, 14 as well as the living hinge 16 and the lock 22, substantially in one manufacturing operation. Once molded, the case can be used to display, transport or store the instrument. If the case 10 is to be used to display the instrument at a point of sale it is preferably made of a transparent plastic material which may be clear or slightly translucent. Thus, once a customer examines the tambourine inside the case and chooses to purchase the tambourine, the case may continue to serve useful functions or purposes after the purchase to protect the instrument against scratching, nicking or other damage when stored or transported.

Although the present invention has been described in some detail by way of illustration and example for purposes of clarity and understanding, it will, of course, be understood that various changes and modifications may be made in the form, details, and arrangements of the parts without departing from the scope of the invention.

The invention claimed is:

1. A protective case in combination with a tambourine having a predetermined configuration, comprising a clam shell housing having a configuration generally conforming to said predetermined configuration and dimensioned to receive the tambourine with clearance, said clam shell housing being formed of two clam shell members that are hinged to each other so that they may be separated to allow the tambourine to be inserted into or removed from the case; locking means for selectively locking said clam shell members to each other to prevent the separation of said clam shell members; a handle suitable for gripping for carrying said case; positioning means within at least one of said clam shell members for positioning the tambourine and stabilizing it against excessive movements within said clam shell housing when said clam shell members are juxtaposed in a closed condition of said clam shell housing, whereby the tambourine is maintained in a generally fixed desired position within said clam shell housing where the protection of the tambourine is enhanced.

2. A protective case as defined in claim 1, wherein said clam shell housing is molded of a plastic material.

3. A protective case as defined in claim 2, wherein said plastic transparent so that the tambourine is visible when the case is closed, whereby the case can also serve as a display.

4. A protective case as defined in claim 1, wherein said locking means comprises a tab on one clam shell member and a detent lip on the other clam shell member, said tab and lip being aligned to create a snap-lock arrangement when said clam shell members are juxtaposed and the case is closed.

5. A protective case as defined in claim 1, wherein said positioning means comprises a holding member that generally follows the contour of the tambourine.

6. A protective case as defined in claim 5, wherein said holding member comprises a continuous wall extending along a substantial portion of the periphery of the tambourine.

7. A protective case as defined in claim 5, wherein said holding member comprises a first portion attached to one clam shell member and a second portion, generally aligned with said first portion, on the other clam shell member, whereby said first and second portion are generally aligned when said clam shell members are juxtaposed.

8. A protective case as defined in claim 6, wherein said wall has an undulating shape to provide spaced points of contact along the periphery of the tambourine.

9. A protective case as defined in claim 5, wherein said holding member comprises a plurality of walls positioned about the tambourine when the case is closed.

10. A protective case as defined in claim 9, wherein two walls are provided one each on opposite sides of at least a portion of the tambourine.

11. A protective case as defined in claim 1, wherein said handle is molded in said case.

12. A protective case as defined in claim 11, wherein said clam shell members include aligned openings proximate to the periphery of the case to form the handle.

13. A protective case as defined in claim 1, wherein the tambourine is a generally elongate tambourine closed on itself to form an internal opening, and the case includes recessed surface portions that generally come into close proximity to each other when the case is closed.

14. A protective case as defined in claim 13, wherein said recessed surface portions are generally flat.

15. A protective case as defined in claim 14, wherein said flat surface portions are suitable for imprinting of a trademark or logo or the like.

16. A protective case as defined in claim 1, further comprising reinforcement means for reinforcing the case and minimizing deformations thereof.

17. A protective case as defined in claim 16, wherein said reinforcement means are provided proximate said handle.

18. A protective case in combination with a tambourine having a longer and shorter arcuate segments or portions to form a generally open crescent-shaped frame defining a continuous periphery and a generally crescent-shaped opening comprising a clam shell housing having a configured generally conforming to said crescent-shaped configuration and dimensioned to receive the tambourine with clearance; said clam shell housing being formed of two claim shell members that are hinged to each other so that they may be separated to allow the tambourine to be inserted into or removed from the case; locking means for selectively locking said clam shell members to each other to prevent the separation of said clam shell members; a handle suitable for gripping for carrying said case; and positioning means within at least one of said clam shell members for positioning the tambourine and stabilizing it against excessive movements within said clam shell housing when said clam shell members are juxtaposed in a closed condition of said clam shell housing, whereby the tambourine is maintained in a generally fixed desired position within said clam shell housing where the protection of the tambourine is enhanced.

19. A protective case as defined in claim 18, wherein said clam shell housing is molded of a plastic material.

20. A protective case as defined in claim 19, wherein said plastic transparent so that the tambourine is visible when the case is closed, whereby the case can also serve as a display.

* * * * *